US008757624B2

(12) United States Patent
Johnston

(10) Patent No.: US 8,757,624 B2
(45) **Date of Patent: *Jun. 24, 2014**

(54) METHOD OF PROVIDING ASSOCIATED WAGERING GAME FOR BLACKJACK

(71) Applicant: Steven G. Johnston, Sahurita, AZ (US)

(72) Inventor: Steven G. Johnston, Sahurita, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/765,980

(22) Filed: Feb. 13, 2013

(65) Prior Publication Data

US 2014/0057690 A1 Feb. 27, 2014

Related U.S. Application Data

(63) Continuation of application No. 13/427,680, filed on Mar. 22, 2012, now Pat. No. 8,382,114.

(60) Provisional application No. 61/466,164, filed on Mar. 22, 2011.

(51) Int. Cl.
*A63F 1/00* (2006.01)

(52) U.S. Cl.
USPC ..... 273/292; 463/16

(58) Field of Classification Search
USPC ..... 273/292, 192, 138 R; 463/16
See application file for complete search history.

(56) References Cited

U.S. PATENT DOCUMENTS

| | | | | |
|---|---|---|---|---|
| 6,341,778 | B1 * | 1/2002 | Lee | 273/292 |
| 6,776,416 | B1 * | 8/2004 | Jackson | 273/292 |
| 6,808,173 | B2 * | 10/2004 | Snow | 273/292 |
| 7,059,965 | B2 * | 6/2006 | Jackson | 463/16 |
| 8,282,460 | B2 * | 10/2012 | Tarantino | 463/13 |
| 2005/0110215 | A1 * | 5/2005 | Jackson | 273/292 |
| 2009/0184473 | A1 * | 7/2009 | Elias et al. | 273/292 |

* cited by examiner

*Primary Examiner* — Masud Ahmed
(74) *Attorney, Agent, or Firm* — Howard & Howard Attorneys PLLC

(57) ABSTRACT

Systems, methods and apparatus for providing, hosting and conducting a wagering game associated with Blackjack, which includes steps and/or components configured for generating a random initial hand of playing cards in the underlying game to form an initial player hand and an initial dealer hand; comparing the random initial player hand of playing cards with a preset qualifying criteria comprising the initial player hand being composed of playing cards which are consecutively ranked; conducting the Blackjack game until a final outcome is achieved; determining a payout award which is at least partially determined by the number of consecutively ranked playing cards in the final player hand if the preset qualifying criteria is satisfied by the initial player hand; and providing the determined payout award or collecting the wager if the preset qualifying criteria is not satisfied.

19 Claims, 3 Drawing Sheets

METHOD OF PROVIDING ASSOCIATED WAGERING GAME FOR BLACKJACK

CROSS-REFERENCE TO RELATED APPLICATIONS

This application is a continuation of U.S. patent application Ser. No. 13/427,680 filed on Mar. 22, 2012, which claims the benefit of U.S. Provisional Patent Application No. 61/466,164 which was filed Mar. 22, 2011, the disclosures of which are hereby incorporated by reference in their entirety.

BACKGROUND OF THE INVENTION

1. Field of the Invention

The invention generally relates to systems and methods of providing, hosting, conducting and/or modifying wagering games. In particular, the invention relates to systems and methods for providing, hosting and/or conducting a modified Blackjack game with an associated wagering game using randomly generated Blackjack outcomes, among other things.

2. Description of the Related Art

Many card games have been developed over the years and some are particularly adapted for gambling. Typically, such games include a dealer who deals cards and one or more players who place wagers on whether an outcome will be achieved based on the cards that the dealer deals. One example in this regard is Blackjack which is also known as Twenty-One.

The objective of Blackjack is for a wagering player to finish a round of play with a hand of playing cards with a sum of the total value of cards coming as close as possible to the value of twenty-one, without the player hand total exceeding twenty-one. The game is played by one or more players against a dealer with the player making an initial wager on a final outcome under the rules of blackjack, which remain fairly consistent throughout the world, and with only minor variations in different casinos or jurisdictions. Players' hands that are less than or equal to twenty-one, and exceed the value of the dealer's hand wins. All players' hands that have a lower sum than the dealer's hand and all hands that exceed the sum of twenty-one lose. Dealer and Player hands with the same total value (without the player first busting, result in ties (called a "push"). An initial two-card hand totaling twenty-one points is called blackjack, and in the absence of the dealer having a similar hand, automatically wins, without respect to the dealer's hand final; count and is often paid at odds greater than 1:1.

One conventional method of playing Blackjack uses one or more standard decks of playing cards (a fifty-two card deck without jokers). Each numbered card is counted according to its face value. The Jacks, Queens and Kings are worth ten (10), and Aces are worth either one (1) or eleven (11), depending on which is most beneficial to the count of the hand. A "ten" card therefore hereinafter includes any card which has a value of ten in the game of Blackjack, that is, a numbered 10 card, Jacks, Queens and Kings. The game begins by dealing two cards to each position where a player has made a wager. The dealer or house is also dealt two cards, usually with one card face up or otherwise exposed to view.

A player views an initial value of cards in the player's hand, views the dealer's up-card (the exposed card) and then makes decisions on drawing or not drawing further playing cards. This further drawing is done in an attempt to try and win the hand by having a higher count than the dealer's hand without busting, or allowing the dealer to bust the house hand. The player can "stand" on any count of twenty-one or less. Once the player exceeds a count of twenty-one or "busts," the player wager is lost, whatever the ultimate point count of the dealer's hand. Usually, the dealer must hit when with a point count of less than seventeen. Normally a dealer must stand on a soft count of at least seventeen, a soft count being a hand value where an Ace is counted as a value of eleven. House rules may vary, however. If a player or dealer receives 21 on their initial hand, such as an Ace and a Ten or Ace and a Jack, this is referred to as a "natural" Blackjack. If a player receives a natural Blackjack as their initial hand, then the player will win the game although some versions of the rules provide that the dealer ties the player if the dealer also has a natural Blackjack. If the dealer receives a natural Blackjack, then all players will lose unless the rules allow a player who has a natural Blackjack as well to win or tie.

Although the game of Blackjack is a consistent winning game for the house, players tend to place the minimum wager on a blackjack game unless the player is using some system or feels that the cards are running in a favorable streak. While Blackjack is a very popular game, many new games which are quickly rising in popularity provide numerous wagering opportunities, thus increasing player participation and excitement. Consequently, further variations of existing wagering games are always of interest to players and casinos, and therefore, there is a desire for methods which would increase wagering in the game of Blackjack.

SUMMARY OF THE INVENTION

The invention is directed to systems, methods and apparatus for providing, hosting and conducting a wagering game associated with Blackjack, which includes steps and/or components configured for randomly generating an initial hand of playing cards in the underlying game to form an initial player hand and an initial dealer hand; comparing the initial player hand of playing cards with a preset qualifying criteria comprising the initial player hand being composed of playing cards which are consecutively ranked; conducting the Blackjack game until a final outcome is achieved; determining a payout award which is at least partially determined by the number of consecutively ranked playing cards in the final player hand if the preset qualifying criteria is satisfied by the initial player hand; and providing the determined payout award or collecting the wager if the preset qualifying criteria is not satisfied, among other things.

Some embodiments of the invention are directed to a method of conducting a wagering game associated with the underlying game of Blackjack, comprising the steps of: receiving a wager relating to the associated wagering game; generating a random initial hand of playing cards in the underlying game to form an initial player hand and an initial dealer hand; comparing the random initial player hand of playing cards with a preset qualifying criteria, wherein the qualifying preset criteria comprises the initial player hand being composed of playing cards which are consecutively ranked; conducting the underlying game until a final outcome is achieved according the rules of the underlying game, wherein additional cards may be added to the initial player hand to form a final player hand for achieving the final outcome of the underlying game; determining a payout award if the preset qualifying criteria is satisfied by the initial player hand, wherein the payout award is at least partially determined by the number of consecutively ranked playing cards in the final player hand; and settling the wager by providing the determined payout award or collecting the wager if the preset qualifying criteria is not satisfied, among other things.

In some embodiments, any of the aforementioned methods may further include the step of receiving a wager which is resolved by the final outcome of the underlying game.

In some embodiments, the qualifying criteria of any of the aforementioned methods may further include the initial player hand being composed of playing cards which are consecutively ranked with no rank being less than a preset minimum ranking. Alternatively, in other embodiments the qualifying criteria further comprises the initial player hand being composed of playing cards which are consecutively ranked and suited.

In some embodiments, any of the aforementioned methods may further involve excluding any card which resulted in the final player hand exceeding a value of twenty-one in conventional Blackjack or otherwise busting in the underlying game if the rules of the underlying game differ from conventional Blackjack.

In some embodiments, the step of generating a random initial hand of playing cards in the underlying game to form an initial player hand and an initial dealer hand may involve dealing two cards from a physical deck of randomly ordered cards, which may be supplied by a card shuffling machine. In other embodiments, a program with a random number generator configured for simulating Blackjack games may be used to generate the random initial hands.

In some embodiments of the aforementioned methods the payout is further determined by the number of consecutively ranked playing cards in a final player hand and their respective suits.

Some embodiments of the invention are directed to a method of conducting a wagering game associated with the underlying game of Blackjack at a gaming table, comprising the steps of: providing a set of randomly-ordered physical playing cards for facilitating play of associated game and Blackjack game at the gaming table; distributing an initial hand of two playing cards from the set of physical playing cards to one or more players and a dealer to form one or more initial player hands of two playing cards each and an initial dealer hand having two playing cards; comparing each of the one or more initial player hands of physical playing cards with a preset qualifying criteria, wherein the qualifying preset criteria includes an initial player hand being composed of two playing cards which are consecutively ranked according to conventional poker rules; conducting the Blackjack game at the gaming table until a final outcome is achieved, wherein additional cards may be added to the initial player hand to form a final player hand for determining the final outcome, the possible final outcomes for each of the final player hands include a loss against the dealer hand, a win against the dealer or a bust; determining a payout for any of the one or more players having initial player hands which satisfy the qualifying preset criteria, wherein the payout is at least partially determined by the number of consecutively ranked playing cards in a final player hand, excluding any card in the final player hand which resulted in a final outcome of a bust in the Blackjack game; and providing a payout if the preset qualifying criteria is satisfied by the initial player hand, among other things.

In some embodiments, the aforementioned method may include the step of receiving a wager represented in a physical form, such as a wagering chip, in connection with play of the associated wagering game and/or the Blackjack game, wherein the wager received in the associated wagering game is collected if the preset qualifying criteria is not satisfied.

In some embodiments, the payout is further determined by the number of consecutively ranked playing cards in the final player hand and at least one of their respective suits or the number of suited, consecutively ranked playing cards in the final player hand.

Some embodiments of the invention are directed to a system for conducting a wagering game associated with the underlying game of Blackjack, comprising: means for generating a random initial hand of playing cards in the underlying game to form an initial player hand and an initial dealer hand; a processor configured for: (i) comparing the random initial player hand of playing cards with a preset qualifying criteria, wherein the qualifying preset criteria comprises the initial player hand being composed of playing cards which are consecutively ranked; (ii) conducting the underlying game until a final outcome is achieved according the rules of the underlying game, wherein additional cards may be added to the initial player hand to form a final player hand for achieving the final outcome of the underlying game; (iii) determining a payout award if the preset qualifying criteria is satisfied by the initial player hand, wherein the payout award is at least partially determined by the number of consecutively ranked playing cards in the final player hand; a communication device configured for: (i) receiving a wager relating to the associated wagering game; and (ii) providing the determined payout if the preset qualifying criteria is satisfied by the initial player hand, among other things.

Depending on the embodiment of the invention, means for generating a random initial hand of playing cards in the underlying game may be a processor, random number generator, software, physical playing cards, a shuffling device, or involve combinations thereof.

In some embodiments, the communication device may be a data input and/or data output device or a remote computer terminal, such as a home computer or mobile device with access to local or global network. The system and communication device may be configured for providing the associated wagering game to players via an online system or the Internet. The processor may also be remotely located from the communication device.

In some embodiments, the system further includes a display device in communication with the communication device for presenting the underlying game and the associated game. The communication device, processor and display device may be mounted within a unitary housing, and the aforementioned system may be an electronic gaming machine or electronic platform including multiple data input devices providing player positions.

Some embodiments of the invention are also directed to a machine readable media for providing a wagering game associated with Blackjack that includes code and/or data segments as necessary to provide and enable any of the methods described herein on hardware or any one or more gaming machines.

DETAILED DESCRIPTION

The exemplary embodiments herein relate to wagering games such as Blackjack or variants and modifications thereof in which additional or side wagers other than the standard underlying game wagers are placed by players and received by the house or casino, or a person or entity acting as a banker of the game, to be subsequently resolved in a secondary wagering game which is resolved at least in part by the partial or intermediate randomly generated results of the standard underlying game.

It should be understood that each of the methods and individual steps recited herein may be partially or wholly carried out in a variety of ways and/or systems, which may include, but are not limited to, a live dealer physically dealing playing cards in a casino, an electronic gaming machine (EGM) for one or more players, standalone multiplayer platforms which may include a player interface such as a touchscreen display and a physical or virtual playing cards, through a home computer or portable computing device, such as a tablet computer or mobile phone capable of communicating with a network or over the Internet, global telecommunication network or world wide web. It should further be understood that the methods and systems of the invention are described herein in connection with a conventional Blackjack game for illustrative purposes only, as the methods and systems of the invention may be employed, combined or integrated with modified, variant or otherwise non-conventional Blackjack games, such as Blackjack games having multiple hands.

Figure 1:
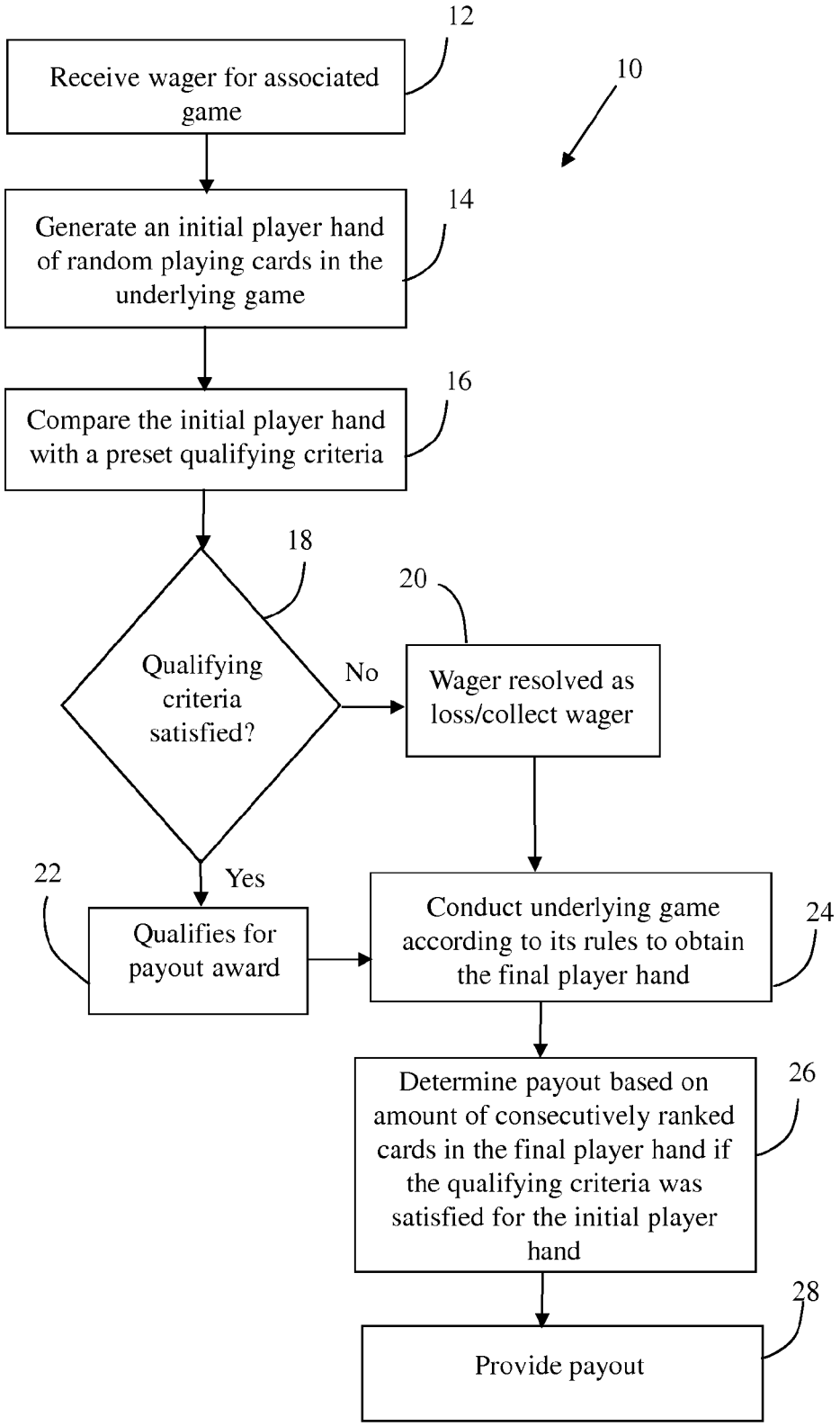
FIG. 1 is a process flow chart depicting an exemplary embodiment of the invention.

FIG. 1 provides an embodiment of a method of providing, hosting and/or conducting a wagering game associated with the underlying game of Blackjack generally referred to by the reference numeral 10.

In step 12, a wager is received relating to the associated wagering game of this embodiment. In this embodiment, the wager is optional, and may be placed with a wager in the underlying game. However, in other embodiments, the wager placed in step 12 may be mandatory, along with a wager placed in the underlying game, so that the player must play both the secondary and underlying wagering games at all times.

In step 14, initial hands of playing cards in the underlying game to form both player and dealer initial hands are randomly generated. In this embodiment, the underlying game is Blackjack. As such, the initial hand of playing cards for the player and dealer each include two cards. However, it should be understood that the initial hand may be composed of any amount of randomly generated cards or symbols representing cards depending on the underlying game.

In step 16, the playing cards in the initial player hand are compared with preset qualifying criteria. In this embodiment, the qualifying criteria are satisfied if the initial player hand includes two cards that are consecutively ranked with respect to each other according to traditional playing card or poker ranking conventions. For example, in poker a "straight" hand consists of cards which are consecutively ranked, where Ace can either be the highest ranked card, ranked successively after the King, or the lowest ranked card, ranked below a "2" or Deuce.

In some embodiments, the qualifying criteria may include other requirements which must be satisfied by the initial hand, such as the requirement that the lowest ranking card of the two hand be of at least of a minimum rank, that the cards include a specific card, or a requirement that the cards be of the same suit, a specific suit or suits, or different suits, for example.

As shown by steps 18 and 20, if the qualifying criteria are not satisfied, then the wager received in step 12 in connection with the associated game is settled, considered a loss and all or a portion thereof is collected, and the underlying game of Blackjack will continue to operate according to its rules in step 24 until the player's hand is a final player hand in the underlying Blackjack game.

As shown by steps 18 and 22, if the qualifying criteria are satisfied then the player has qualified for a potential award, the wager in the associated game will not be collected and the Blackjack game will continue to operate according to its rules in step 24 until the player's hand is a final player hand in the underlying Blackjack game.

It should be understood that for purposes of this embodiment, a final player hand is a player's hand of cards which according to the rules of the underlying game is in a condition which allows for the outcome of the wager received in connection with the underlying game to be resolved. For example, in Blackjack, the final player hand for any player may occur at the final outcome of the game or round of play for all players involved in the game, that is, when the final player hands are either a win or a loss against the final dealer hand. In conventional Blackjack, the final player hand may be formed prior to the final outcome if the final player hand busts in the underlying game.

In step 26, the composition of the final player hand for any player having an initial player hand that satisfied the qualifying criteria in step 16 will be compared with one or more award determining rules which will be applied to determine a payout award. In this embodiment, the payout award is at least partially determined by the number of consecutively ranked cards in the final player hand, wherein the payouts start with a first amount for two consecutively ranked cards which were in the initial player hand, and increase for each additional consecutively ranked card added thereafter to form the final player hand.

In other embodiments, the payout award may be determined by other characteristics of the cards in the final player hand, such as the number of consecutively ranked cards in the final player hand which are also of the same suit, different suit or specific suits, or the number of consecutively ranked cards of at least a particular ranking. The payout award may be determined in some embodiments by the final player hand including a particular card, cards or set of consecutively ranked cards, which may also have relevance in the underlying game. It should be readily apparent that combinations of any of the above award determining rules may also be used in accordance with the invention.

In some embodiments, the final player hand for the associated game will not include a card that caused the final player hand to bust in the underlying game, even if the "bust card" was a consecutively ranked card with respect to the other cards in the player's hand. In some embodiments, the final player hand will not be entitled to an award if the final player hand busts or loses in the underlying game against the dealer, or both.

As shown in step 28, a payout award will be provided to the player according to the payout award determined by the award determining rules of this embodiment.

It should be understood that in some alternative embodiments, the underlying game may be played until the final hands are compared with the preset qualifying criteria and award determining rules to consider the player's respective initial player hand results to determine if the player has qualified for an award and determine the award.

In an exemplary embodiment, the underlying game is Blackjack, the qualifying criteria is any two consecutive cards in the initial player hand, and the award determining rules are set forth in the table below.

Exemplary Award Determining Rules Table

| If the initial hand satisfies qualifying criteria and the final hand without a bust card includes: | The payout award should be: |
|---|---|
| Ace through 10, two card consecutive hand | 1 to 1 |
| Ace through 10, two card consecutive hand, suited | 2 to 1 |
| Ace through 10, three card consecutive hand | 5 to 1 |
| Ace through 10, three card consecutive hand, suited | 10 to 1 |
| Jack through Ace, two card consecutive hand | 3 to 1 |
| Jack through Ace, two card consecutive hand, suited | 8 to 1 |
| Jack through Ace, three card consecutive hand | 15 to 1 |
| Jack through Ace, three card consecutive hand, suited | 20 to 1 |
| Any four card consecutive hand | 50 to 1 |
| Any five card consecutive hand (a "straight" in poker terms) | 100 to 1 |
| Any five card consecutive hand, suited (a "straight flush" in poker terms) | 500 to 1 |
| Ace through six, six card consecutive hand (equaling "21" in Blackjack rules) | 1000 to 1 |
| Ace through six, six card consecutive hand with Ace of spades | 5000 to 1 |

It should be understood that the wager and payouts may be expressed in such terms as set amounts, odds payouts, multiples of the unit side wager, all or portions of a standard progressive meter, or combinations thereof. It should also be readily apparent that the above paytable is provided for illustrative purposes and may be altered accordingly based on a variety of factors.

Figure 2:
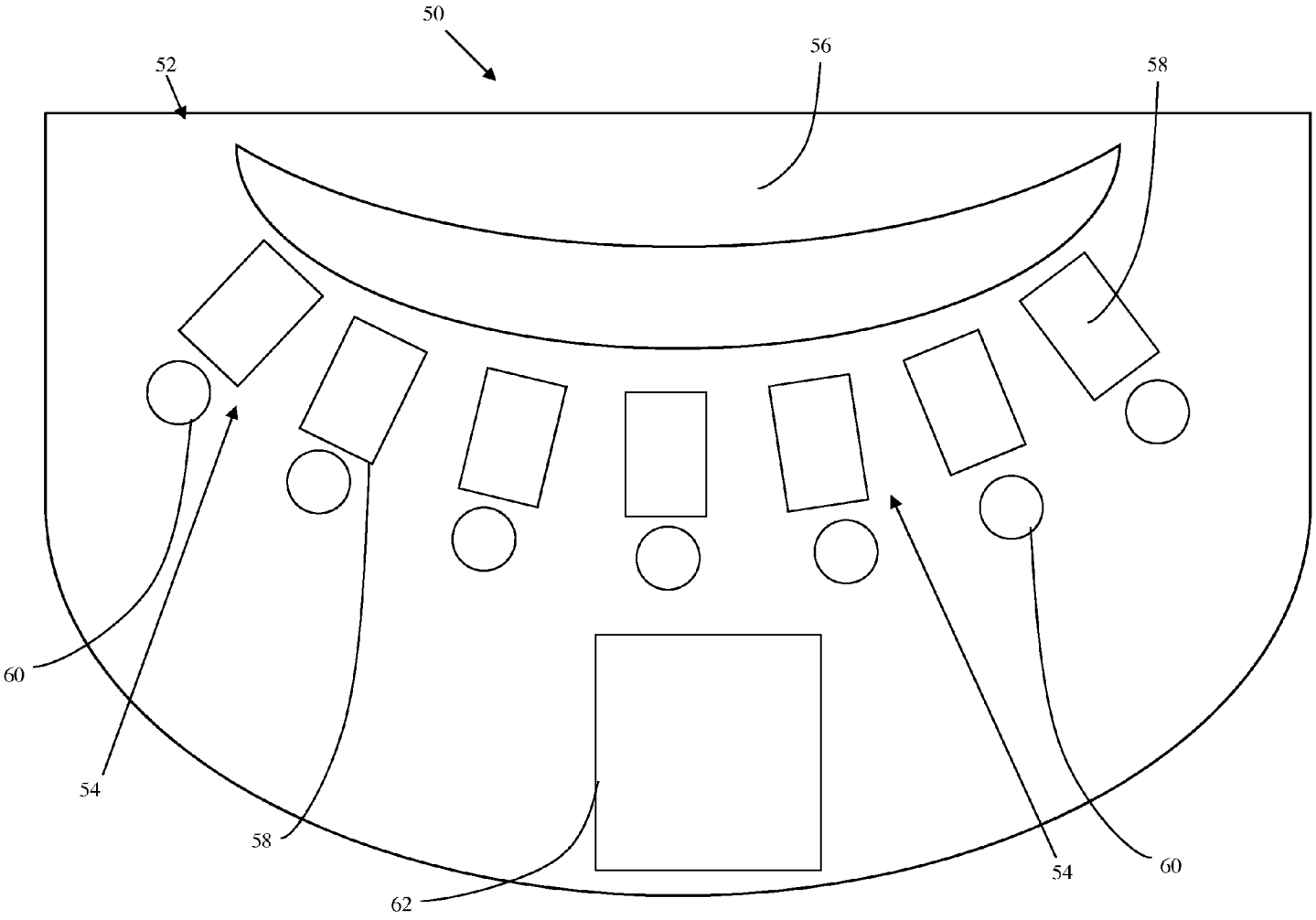
FIG. 2 is a schematic diagram of an exemplary table layout configured for use with methods according to some embodiments of the invention, including physical or live table systems and virtual or partially virtual electronic platforms.

FIG. 2 illustrates an exemplary system 50 configured for operating in accordance with embodiments of the invention, such as method 10. System 50 includes a layout 52 for use in facilitating the presentment and display of a method 10 and various embodiments thereof as described herein. Layout 52 may be a physical or virtual representation of a felt table display, as it should be understood that the methods of the invention would function as described herein if any one or more of the layout, cards, dealers or wagering chips or apparatus were virtually or physically represented. System 50 further includes multiple player positions or interfaces 54 accessible on layout 52 and a dealer position or interface 56. In this embodiment, payouts are based on the award determining rules after satisfying the qualifying criteria, as described in the embodiments herein. Each player position 54 includes a card receiving area 58 and an associated game wagering area 60 from which wagers on the associated game described herein may be received. A payout table 62 may display the game rules and payout awards available.

Figure 3:
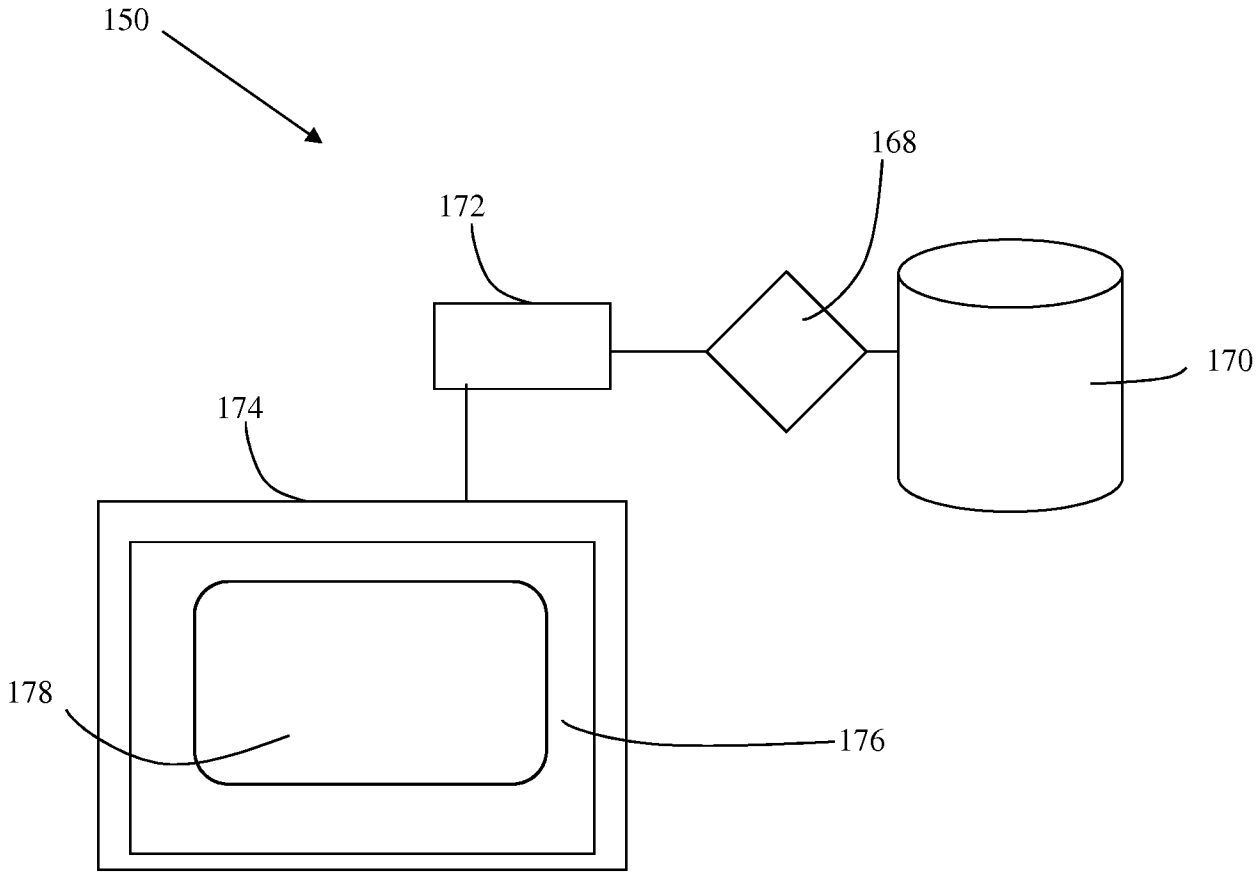
FIG. 3 is a schematic diagram of exemplary system components configured for use with methods according to some embodiments of the invention.

FIG. 3 illustrates an exemplary system 150 constructed in accordance with some embodiments of the invention. System 150 includes processing device 168 in communication with a database or memory device 170, communication or data input/output device 172 and a display device 174. In some embodiments, display device 174 is a touch-enabled device and includes a data input device component. Memory device 170 may include data relating to the underlying game and embodiments of the invention as described herein, such as the qualifying criteria and award determining rules. A player position 176 is displayed on display device 174 along with virtual representation of a layout and wagering area 178 for transmitting wagers in accordance with any of the embodiments herein, such as method 10. Game outcomes are displayed and wagers are tracked using display device 174 and processing device 168 compares the initial player hand with the qualifying criteria, storing information relating to the satisfaction of the qualifying preset criteria in memory 170, and in some embodiments, communicating the satisfaction of the criteria via device 172, through display 174, or both. Processing device 168 compares the award determining rules stored in memory 170 in connection with any player initial hands having satisfied the qualifying criteria. If appropriate, a payout will be determined by processing device 168 and either communicated via device 172, indicated on display device 174, or both.

Those skilled in the art will readily appreciate that the methods described herein may be incorporated in a system in accordance with the invention using virtual representations of Blackjack table layouts. The system of the invention may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as a mobile device. The system of the invention may be provided on electronic platforms with multiple player positions. In addition, the system of the invention may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the invention so long as players and operators thereof are provided with useful access thereto or the opportunity to play the game as described herein.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth in the claims and equivalents thereto.

What is claimed is:

1. A method of conducting a wagering game associated with the underlying game of Blackjack, comprising the steps of:

a) receiving a wager relating to the associated wagering game;

b) generating a random initial hand of playing cards in the underlying game from a set of randomly-ordered physical playing cards to form an initial player hand and an initial dealer hand;

c) comparing the random initial player hand of playing cards with a preset qualifying criteria, wherein the qualifying preset criteria comprises the initial player hand being composed of playing cards which are consecutively ranked;

e) conducting the underlying game until a final outcome is achieved according the rules of the underlying game, wherein additional cards may be added to the initial player hand to form a final player hand for achieving the final outcome of the underlying game;

f) determining a payout award if the preset qualifying criteria is satisfied by the initial player hand, wherein the payout award is at least partially determined by the number of consecutively ranked playing cards in the final player hand; and g) settling the wager by providing the determined payout award or collecting the wager if the preset qualifying criteria is not satisfied.

2. A method according to claim 1, further comprising the step of receiving a wager which is resolved by the final outcome of the underlying game.

3. A method according to claim 1, wherein the qualifying criteria further comprises the initial player hand being composed of playing cards which are consecutively ranked with no rank being less than a preset minimum ranking.

4. A method according to claim 1, wherein the qualifying criteria further comprises the initial player hand being composed of playing cards which are consecutively ranked and suited.

5. A method according to claim 1, wherein the step of determining a payout award if the preset qualifying criteria is satisfied by the initial player hand, wherein the payout award is at least partially determined by the number of consecutively ranked playing cards in the final player hand, further comprises determining a payout award if the preset qualifying criteria is satisfied by the initial player hand, wherein the payout award is at least partially determined by the number of consecutively ranked playing cards in the final player hand excluding any card which resulted in the final player hand exceeding a value of twenty-one in the underlying game.

6. A method according to claim 1, wherein the step of generating a random initial hand of playing cards in the underlying game to form an initial player hand and an initial dealer hand further comprises generating an initial hand of two cards for the player and an initial hand of two cards for the dealer.

7. A method according to claim 1, wherein the set of randomly-ordered physical playing cards comprises at least one randomly ordered deck of physical playing cards.

8. A method according to claim 1, wherein the payout is further determined by the number of consecutively ranked playing cards in a final player hand and their respective suits.

9. A method of conducting a wagering game associated with the underlying game of Blackjack at a gaming table, comprising the steps of:

a) a processor for facilitating the random ordering of a set of physical playing cards from at least one deck of standard playing cards in a card shuffling apparatus, and providing the subsequent set of randomly-ordered physical playing cards for use in the play of an associated game and Blackjack game at the gaming table;

b) distributing an initial hand of two playing cards from the set of physical playing cards to one or more players and a dealer to form one or more initial player hands of two playing cards each and an initial dealer hand having two playing cards;

c) comparing each of the one or more initial player hands of physical playing cards with a preset qualifying criteria, wherein the qualifying preset criteria includes an initial player hand being composed of two playing cards which are consecutively ranked according to conventional poker rules;

d) conducting the Blackjack game at the gaming table until a final outcome is achieved, wherein additional cards may be added to the initial player hand to form a final player hand for determining the final outcome, the possible final outcomes for each of the final player hands include a loss against the dealer hand, a win against the dealer or a bust;

e) determining a payout for any of the one or more players having initial player hands which satisfy the qualifying preset criteria, wherein the payout is at least partially determined by the number of consecutively ranked playing cards in a final player hand, excluding any card in the final player hand which resulted in a final outcome of a bust in the Blackjack game; and f) providing a payout if the preset qualifying criteria is satisfied by the initial player hand.

10. A method according to claim 9, further comprising the step of receiving a wager represented in a physical form in connection with play of the associated wagering game, wherein the wager is collected if the preset qualifying criteria is not satisfied.

11. A method according to claim 9, wherein the payout is further determined by the number of consecutively ranked playing cards in the final player hand and at least one of their respective suits.

12. A method according to claim 9, wherein the payout is further determined by the number of suited, consecutively ranked playing cards in the final player hand.

13. A method according to claim 9, further comprising the step of receiving a wager represented in a physical form in connection with play of the Blackjack game.

14. A system for providing a wagering game associated with the underlying game of Blackjack, comprising:

a) means for randomly generating an initial hand of playing cards in the underlying game to form an initial player hand and an initial dealer hand;

b) a processor configured for:

(i) comparing the random initial player hand of playing cards with a preset qualifying criteria, wherein the qualifying preset criteria comprises the initial player hand being composed of playing cards which are consecutively ranked;

(ii) determining a payout award if the preset qualifying criteria is satisfied by the initial player hand, wherein the payout award is at least partially determined by the number of consecutively ranked playing cards in a final player hand;

c) a communication device configured for:

(i) receiving the number of consecutively ranked playing cards in the final player hand; and (ii) transmitting information regarding the determined payout award if the preset qualifying criteria is satisfied by the initial player hand.

15. A system as recited in claim 14, wherein means for randomly generating an initial hand of playing cards in the underlying game comprises a random number generator.

16. A system as recited in claim 14, wherein means for randomly generating an initial hand of playing cards in the underlying game comprises at least one deck of randomly ordered playing cards.

17. A system as recited in claim 14, further comprising a display device configured for displaying the outcome of the underlying game and results of the associated wagering game.

18. A system according to claim 17, wherein the processor is remotely located from the display device.

19. A system as recited in claim 14, wherein the communication device and processor are mounted in a unitary housing.

* * * * *